US010984624B2

(12) United States Patent
Nishida et al.

(10) Patent No.: US 10,984,624 B2
(45) Date of Patent: Apr. 20, 2021

(54) PAPER SHEET HANDLING APPARATUS AND PAPER SHEET HANDLING METHOD

(71) Applicant: FUJITSU FRONTECH LIMITED, Inagi (JP)

(72) Inventors: Mitsutaka Nishida, Inagi (JP); Hayato Minamishin, Inagi (JP); Naoto Ikeda, Inagi (JP); Tatsuya Shimamura, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 156 days.

(21) Appl. No.: 16/352,427

(22) Filed: Mar. 13, 2019

(65) Prior Publication Data

US 2019/0213824 A1 Jul. 11, 2019

Related U.S. Application Data

(63) Continuation of application No. PCT/JP2016/078726, filed on Sep. 28, 2016.

(51) Int. Cl.
*G07D 11/235* (2019.01)
*G07D 11/18* (2019.01)
(Continued)

(52) U.S. Cl.
CPC ..... *G07D 11/235* (2019.01); *G07D 11/14* (2019.01); *G07D 11/16* (2019.01); *G07D 11/18* (2019.01); *G07D 11/237* (2019.01)

(58) Field of Classification Search
CPC ..... G07D 11/14; G07D 11/18; G07D 11/237; G07D 11/235
See application file for complete search history.

(56) References Cited

U.S. PATENT DOCUMENTS

2008/0038038 A1* 2/2008 Arai ..... G07D 11/237 400/582
2014/0326575 A1 11/2014 Nemoto
(Continued)

FOREIGN PATENT DOCUMENTS

CN 102622806 8/2012
CN 103988237 8/2014
(Continued)

OTHER PUBLICATIONS

Chinese Office Action dated Jul. 20, 2020 in Chinese Patent Application No. 201680089441.0.
(Continued)

*Primary Examiner* — Jeremy R Severson
(74) *Attorney, Agent, or Firm* — Staas & Halsey LLP

(57) ABSTRACT

A paper sheet handling apparatus includes an input/output unit that is used to put in or take out a paper sheet; a distinguishing unit that distinguishes the paper sheet; an accommodating unit that temporarily accommodates the paper sheet sent from the input/output unit; a storage unit that stores therein the paper sheet sent from the accommodating unit; a conveying mechanism that includes a two-way direction conveying path that connects the input/output unit, the distinguishing unit, the accommodating unit, and the storage unit with each other and conveys the paper sheet in both directions; and a controller that is configured to control the conveying mechanism.

5 Claims, 6 Drawing Sheets

(51) Int. Cl.

| | |
|---|---|
| ***G07D 11/14*** | (2019.01) |
| ***G07D 11/237*** | (2019.01) |
| ***G07D 11/16*** | (2019.01) |

(56) References Cited

U.S. PATENT DOCUMENTS

| | | | |
|---|---|---|---|
| 2015/0307306 | A1 | 10/2015 | Kadota |
| 2017/0345244 | A1 | 11/2017 | Wada et al. |

FOREIGN PATENT DOCUMENTS

| | | |
|---|---|---|
| JP | 6-72590 | 3/1994 |
| JP | 6-295369 | 10/1994 |
| JP | 10-188074 | 7/1998 |
| JP | 11-195159 | 7/1999 |
| JP | 2000-30119 | 1/2000 |
| JP | 2001-307182 | 11/2001 |
| JP | 2011-2921 | 1/2011 |
| JP | 2011-146018 | 7/2011 |
| JP | 2014-109797 | 6/2014 |
| JP | 2014-123222 | 7/2014 |
| JP | 2014-241168 | 12/2014 |
| JP | 2016-27502 | 2/2016 |
| JP | 2016-81289 | 5/2016 |
| JP | 2016-91099 | 5/2016 |
| WO | WO 2016/147347 A1 | 9/2016 |

OTHER PUBLICATIONS

Japanese Office Action dated Jul. 23, 2019 in corresponding Japanese Patent Application No. 2018-541792.

International Search Report dated Nov. 15, 2016 in corresponding International Application No. PCT/JP2016/078726.

Written Opinion of the International Searching Authority dated Nov. 15, 2016 in corresponding International Application No. PCT/JP2016/078726.

Japanese Office Action dated Dec. 10, 2019 in corresponding Japanese Patent Application No. 2018-541792.

* cited by examiner

PAPER SHEET HANDLING APPARATUS AND PAPER SHEET HANDLING METHOD

CROSS-REFERENCE TO RELATED APPLICATION

This application is a continuation application of International Application PCT/JP2016/078726, filed on Sep. 28, 2016 and designating the U.S., the entire contents of which are incorporated herein by reference.

FIELD

The present invention relates to a paper sheet handling apparatus and a paper sheet handling method.

BACKGROUND

For example, an automated teller machine (hereinafter, referred to as an ATM) includes a banknote handling apparatus that handles banknotes as paper sheets. The banknote handling apparatus sends the banknotes inserted in a deposit and withdrawal unit along a conveying path, and conveys the banknotes to each of a distinguishing unit that discriminates banknotes, a holding unit that temporarily accommodates the banknote, a storage unit that stores therein the banknote, and the like.

Patent Literature 1: Japanese Laid-open Patent Publication No. 2011-002921

Incidentally, in the banknote handling apparatus, in some cases, a so-called jam, i.e., a banknote is stuck in the conveying path, occurs caused by, for example, a deterioration state of a banknote. When a jam occurs, a maintenance person performs a maintenance task of finding a location in which the jam has occurred in the conveying path, opening the conveying path, removing the jammed banknote from the conveying path, thereby resulting in the inconvenience of the banknote handling apparatus being stopped during the period of time at which the maintenance task is being performed.

As a related technology of the banknote handling apparatus, there is a known configuration in which, because of design ideas of an opening-and-closing mechanism that opens and closes a conveying path, a jammed banknote can be easily and manually removed from a conveying path.

SUMMARY

According to an aspect of the embodiments, a paper sheet handling apparatus includes: an input/output unit that is used to put in or take out a paper sheet; a distinguishing unit that distinguishes the paper sheet; an accommodating unit that temporarily accommodates the paper sheet sent from the input/output unit; a storage unit that stores therein the paper sheet sent from the accommodating unit; a conveying mechanism that includes a two-way direction conveying path, which connects the input/output unit, the distinguishing unit, the accommodating unit, and the storage unit with each other and which conveys the paper sheet in both directions; and a controller that is configured to control the conveying mechanism.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Preferred embodiments of a paper sheet handling apparatus and a paper sheet handling method disclosed in the present invention, will be explained in detail below with reference to the accompanying drawings. Furthermore, the paper sheet handling apparatus and the paper sheet handling method disclosed in the present invention, are not limited to the embodiments described below.

Embodiment (Configuration of a Banknote Handling Apparatus)

Figure 1:
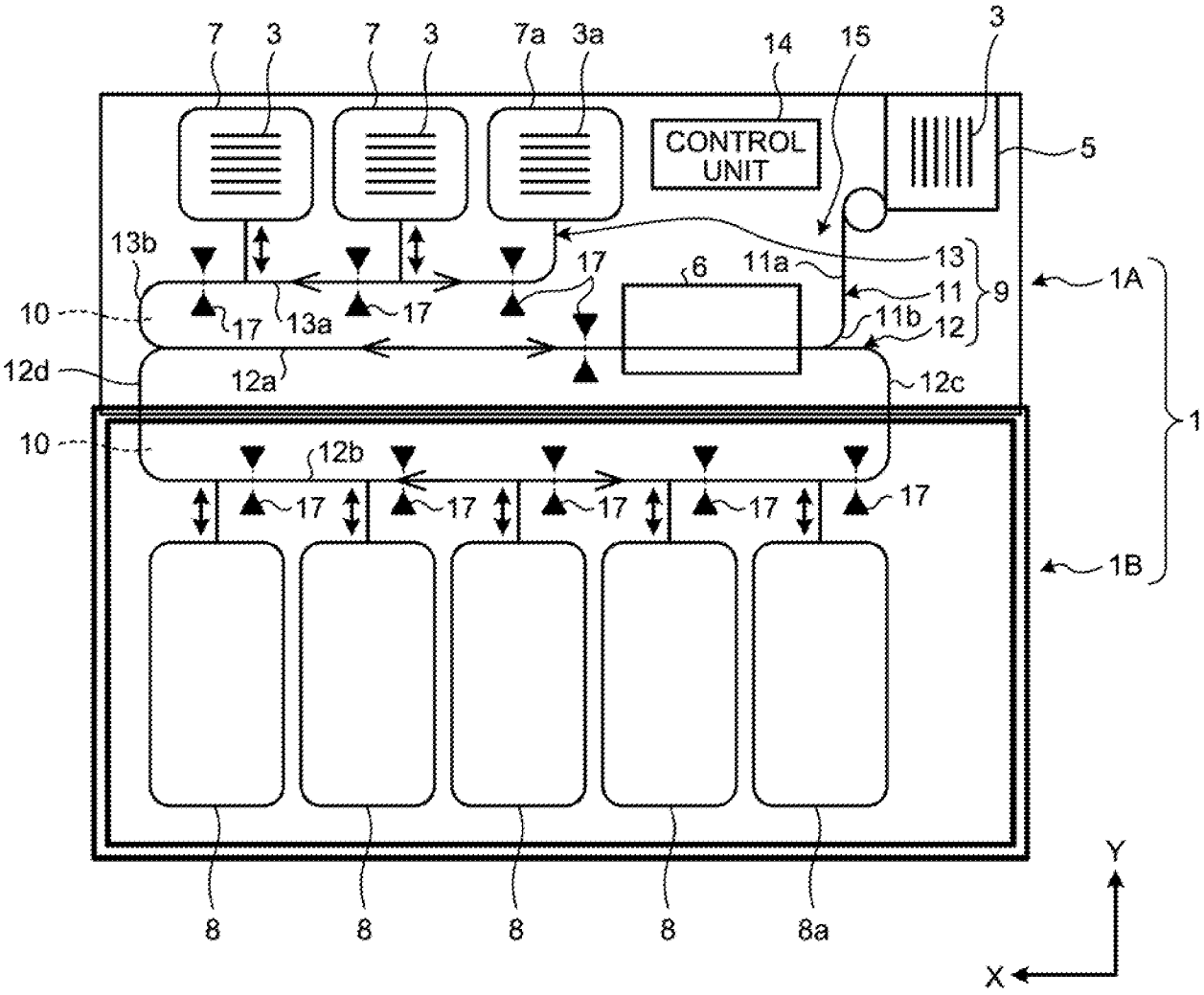
FIG. 1 is a schematic diagram illustrating a banknote handling apparatus according to an embodiment.

FIG. 1 is a schematic diagram illustrating a banknote handling apparatus according to an embodiment. As illustrated in FIG. 1, a banknote handling apparatus 1 according to the embodiment includes a deposit and withdrawal unit 5 that functions as an input/output unit in which a banknote 3 is deposited and withdrawn, a distinguishing unit 6 that distinguishes the banknotes 3, a plurality of holding units 7 each of which functions as an accommodating unit that temporarily accommodates the banknote 3, and a plurality of storage units 8 each of which stores the banknote 3. Furthermore, the banknote handling apparatus 1 includes a conveying mechanism 10, which has a two-way direction conveying path 9 that connects the deposit and withdrawal unit 5, the distinguishing unit 6, the holding units 7, and the storage units 8 with each other and that conveys the banknotes 3 in both directions, and includes a control unit 14 that controls the conveying mechanism 10.

In the plurality of the storage unit 8, the banknotes 3 are classified into types of currencies and stored. Furthermore, the number of the holding units 7 and the storage units 8 is not limited to the plurality of the holding units 7 and the storage units 8; however, the banknote handling apparatus 1 may be configured such that at least a single piece of the holding unit 7 and a single piece of the storage unit 8 are provided. Furthermore, the control unit 14 controls each of the deposit and withdrawal unit 5, the distinguishing unit 6, the holding units 7, and the storage units 8.

Furthermore, the banknote handling apparatus 1 includes an upper row portion 1A and a lower row portion 1B. In the upper row portion 1A, the deposit and withdrawal unit 5, the distinguishing unit 6, and the holding units 7 are arranged. In the lower row portion 1B, the storage units 8 are arranged. For convenience of description, in FIG. 1 and the subsequent drawings, as an example of the arrangement of the banknote handling apparatus 1, the horizontal direction of the banknote handling apparatus 1 is assumed to be the X direction, and the vertical direction of the banknote handling apparatus 1 is assumed to be the Y direction. In the banknote handling apparatus 1, the X direction is not limited to the horizontal direction and the Y direction is not limited to the vertical direction.

The banknotes 3, which is sent to inside the banknote handling apparatus 1 by the deposit and withdrawal unit 5, is sent to the holding unit 7 via, for example, the distinguishing unit 6 that distinguishes the banknotes 3. Furthermore, the deposit and withdrawal unit 5 in the banknote handling apparatus 1 functions both a deposit unit and a withdrawal unit; however, a deposit unit and a withdrawal unit may also be separately provided. In the embodiment, both the deposit unit and the withdrawal unit are collectively referred to as the deposit and withdrawal unit 5.

An example of the banknotes 3 includes banknotes formed of, for example, a resin material, such as polymer. Furthermore, the banknote handling apparatus 1 according to the present invention will be described by using, for example, the banknote 3 as an example of a paper sheet in the embodiment; however, the paper sheet is not limited to the banknotes 3. Examples of the paper sheet include, in addition to the banknote 3, a cash voucher, a negotiable instrument, a voucher, and other media having monetary values.

(Configuration of Two-Way Direction Conveying Path)

As illustrated in FIG. 1, the two-way direction conveying path 9 has a first conveying path 11 that has a linear shape and that conveys the banknote 3 to the deposit and withdrawal unit 5, a second conveying path 12 that has a ring shape and to which one end of the first conveying path 11 is connected, and a third conveying path 13 that has a linear shape and one end of which is connected to the second conveying path 12. The two-way direction conveying path 9 is configured such that, in the same conveying paths (11, 12, and 13), reciprocating conveyance is possible in one direction and the opposite direction thereof.

The first conveying path 11 includes a linear path 11*a* extending from the deposit and withdrawal unit 5, and a connecting path 11*b* connected to the second conveying path 12. The second conveying path 12 includes a single set of linear paths 12*a* and 12*b* that are arranged along parallel on the upper side and the lower side, and a single set of connecting paths 12*c* and 12*d* each of which connects both ends of the linear paths 12*a* and 12*b*.

The second conveying path 12 is provided so as to extend over both of the upper row portion 1A and the lower row portion 1B in the banknote handling apparatus 1. In the second conveying path 12, the single set of the connecting paths 12*c* and 12*d* is arranged so as to extend over both the upper row portion 1A and the lower row portion 1B in the vertical direction (Y direction). The single set of the linear paths 12*a* and 12*b* that are arranged on the upper side and the lower side extends along the horizontal direction (X direction). The linear path 12*a* located on the upper side, is arranged in the upper row portion 1A, whereas the linear path 12*b* located on the lower side, is arranged in the lower row portion 1B.

The third conveying path 13 includes a linear path 13*a* that extends parallel to the single set of the linear paths 12*a* and 12*b*, which are arranged on the upper side and the lower side of the second conveying path 12, and a connecting path 13*b* that is connected to the second conveying path 12. The connecting path 13*b* in the third conveying path 13 is bent in a U-shaped manner, and is connected to the linear path 12*a* that is located on the upper side of the second conveying path 12. The linear path 13*a* extends up to before the position of the distinguishing unit 6 in the X direction.

As illustrated in FIG. 1, the distinguishing unit 6 is arranged, as one route of the second conveying path 12, on the linear path 12*a* that is located on the upper side. Furthermore, the storage unit 8 is connected to the linear path 12*b* that is located on the lower side as another route and that is parallel to the linear path 12*a*, which is located on the upper side of the second conveying path 12. On the outer circumference side of the linear path 12*a* of the ring shaped second conveying path 12 with respect to the distinguishing unit 6, i.e., above the distinguishing unit 6, a non-conveying area 15, in which the banknote 3 is not conveyed along the linear path 12*a*, is provided. In other words, in the vertical direction (Y direction) of the banknote handling apparatus 1, above the distinguishing unit 6, the linear path 13*a*, which is included in the third conveying path 13, does not extend such that the banknote 3 does not pass above the distinguishing unit 6.

The holding unit 7 is connected to the third conveying path 13 and is in a shape of winding drum, which accommodates the banknotes 3 by winding the banknotes 3 around the winding drum (not illustrated). The holding unit 7 includes a damaged banknote holding unit 7*a* that temporarily accommodates only a damaged banknote 3*a* as a degraded banknote. Based on the judgement result obtained by the distinguishing unit 6, it is determined whether the banknote 3 is the damaged banknote 3*a* or not. As the damaged banknote 3*a*, for example, the banknote 3 in a low distinguished state and the banknote 3 that is not able to be distinguished, are included.

The storage unit 8 is connected to the second conveying path 12. The storage unit 8 includes a collecting unit 8*a* that is used to collect the damaged banknote 3*a*, which has been judged when the banknote 3 is sent, as a withdrawal, from the storage unit 8 to the deposit and withdrawal unit 5. Furthermore, the number of the damaged banknote holding units 7*a* and the collecting units 8*a* is not limited to one. The number of the damaged banknote holding units 7*a* and the collecting units 8*a* may also appropriately be adjusted in accordance with an actual use environment or the like of the banknote handling apparatus 1.

The conveying mechanism 10 includes a conveying belt that constitutes the two-way direction conveying path 9, and includes a driving roller that drives the conveying belt, and is electrically connected to the control unit 14. In the conveying mechanism 10, because the direction of rotation of the driving roller is switched by the control unit 14, the conveying direction of the banknote 3 that is conveyed by using the conveying belt, becomes the opposite direction. Furthermore, the conveying mechanism 10 includes an opening-and-closing mechanism 21, which is used to open and close both of the second conveying path 12 and the third conveying path 13. A specific configuration of the opening-and-closing mechanism 21 will be described later.

Figure 2:
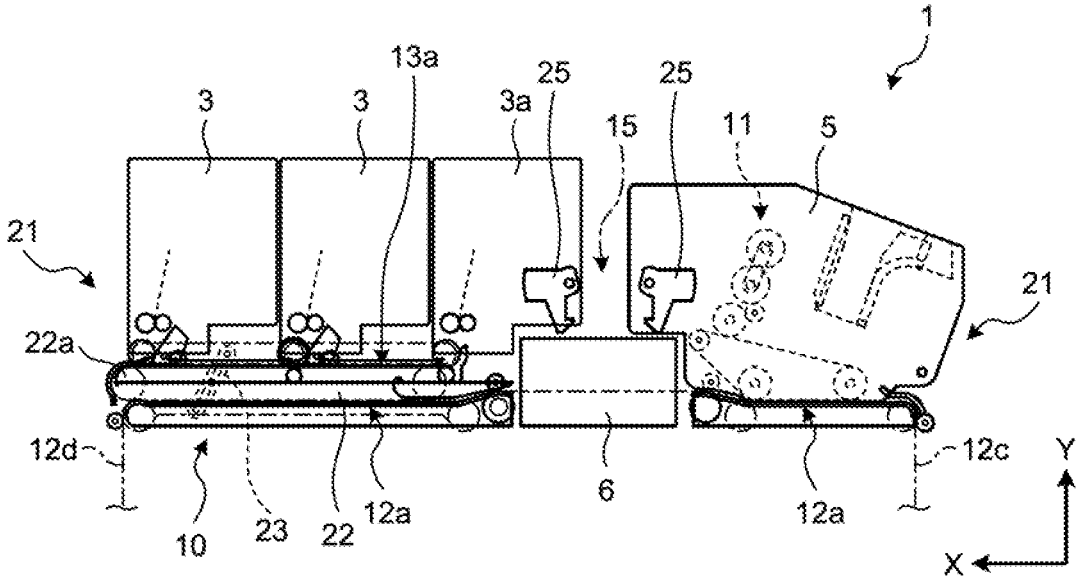
FIG. 2 is a side view illustrating the state in which, in the banknote handling apparatus according to the embodiment, both side routes of a distinguishing unit in a second conveying path, are closed.
Figure 3:
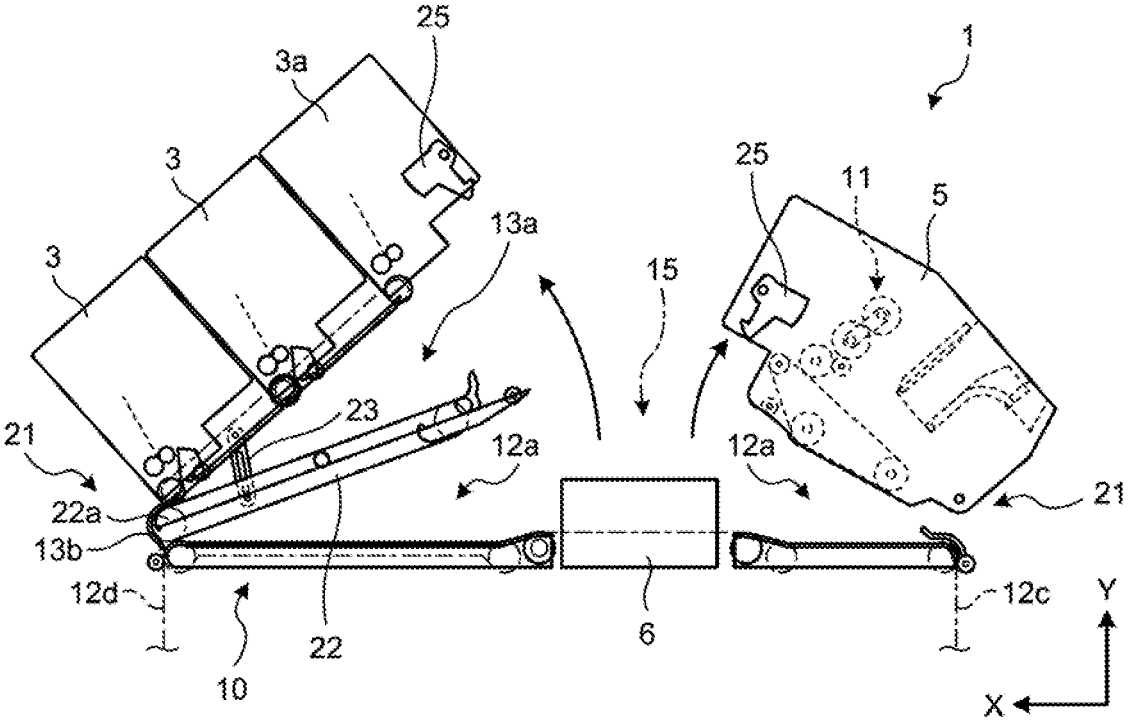
FIG. 3 is a side view illustrating the state in which, in the banknote handling apparatus according to the embodiment, the both side routes of the distinguishing unit in the second conveying path, are opened.

FIG. 2 is a side view illustrating the state, in which, in the banknote handling apparatus 1 according to the embodiment, both side routes of the distinguishing unit 6 in the second conveying path 12 are closed. FIG. 3 is a side view illustrating the state, in which, in the banknote handling apparatus 1 according to the embodiment, the both side routes of the distinguishing unit 6 in the second conveying path 12 are opened. As illustrated in FIG. 2 and FIG. 3, the conveying mechanism 10 includes the opening-and-closing mechanism 21 that is used to open and close the both side routes (an upstream route and a downstream route) of the distinguishing unit 6 in the linear path 12*a* of the second conveying path 12. The opening-and-closing mechanism 21 opens and closes, in addition to the linear path 12*a*, which is located on the upper side of the second conveying path 12, the upper part of the distinguishing unit 6. Furthermore, a description of the opening-and-closing mechanism performed on other routes, such as the linear path 12*b* located on the lower side of the second conveying path 12 or the like, will be omitted; however, the other routes are also configured so as to be opened and closed.

Specifically, as illustrated in FIG. 2 and FIG. 3, the opening-and-closing mechanism 21 according to the embodiment is configured such that both of the linear path 13*a*, which is included in the third conveying path 13, and a part of the linear path 12*a*, which is located on the upper side of the second conveying path 12 and is parallel to the linear path 13*a*, for example, the one side route (downstream route) of the distinguishing unit 6, can be opened and closed in conjunction with each other. The opening-and-closing mechanism 21 includes a frame (not illustrated) that supports the deposit and withdrawal unit 5 so as to be rotatable with respect to the upstream route (the right side in FIG. 3) of the distinguishing unit 6 in the linear path 12*a*, which is included in the second conveying path 12. Furthermore, the opening-and-closing mechanism 21 includes a frame 22 that support the third conveying path 13 so as to be rotatable about the downstream route (the left side in FIG. 3) of the distinguishing unit 6 in the linear path 12*a*, which is included in the second conveying path 12, and a frame (not illustrated) that supports the group of the holding units 7 so as to be rotatable with respect to the linear path 13*a*, which is included in the third conveying path 13. Furthermore, a locking member 25, which regulates an opening and closing operation of the opening-and-closing mechanism 21, is provided in each of the frame that supports the group of the holding units 7 and the frame that supports the deposit and withdrawal unit 5.

In the frame 22, one end 22*a*, which is located on the side opposite to the distinguishing unit 6 in the third conveying path 13, is provided in a rotatable manner and is connected to the frame, which supports the group of the holding units 7 in a rotatable manner, so as to be operated together via a link member 23. Furthermore, in the frame 22, the conveying belt and the conveying roller, which constitute one side of the second conveying path 12, are provided, and the conveying belt and the conveying roller, which constitute one side of the third conveying path 13, are provided.

In the opening-and-closing mechanism 21 configured described above, for example, when a downstream route of the distinguishing unit 6 in the linear path 12*a*, which is located on the upper side of the second conveying path 12, is opened, the locking member 25 in a lock state is released and the frame, which supports the group of the holding units 7, is operated in a rotatable manner. In accordance with the rotation of the frame that supports the group of the holding units 7, the frame 22 is rotated in conjunction with the rotation of the frame via the link member 23. With this operation in conjunction with each other in this manner, the opening-and-closing mechanism 21 opens the linear path 12*a*, which is located on the upper side of the second conveying path 12, and the linear path 13*a*, which is included in the third conveying path 13, by a single operation. Furthermore, when the opening-and-closing mechanism 21 opens the upstream route of the distinguishing unit 6 in the linear path 12*a* in the second conveying path 12, the opening-and-closing mechanism 21 opens the second conveying path 12, the lock state of the locking member 25 is released and the frame, which supports the deposit and withdrawal unit 5, is operated in in a rotatable manner.

Then, as illustrated in FIG. 3, with the opening-and-closing mechanism 21, it is possible to widely open the upper portion of the distinguishing unit 6 when the second conveying path 12 and the third conveying path 13 are opened, and thus free space is generated above the distinguishing unit 6. Consequently, it is possible to easily check each of the linear path 12*a*, located on the upper side of the second conveying path 12, and the linear path 13*a*, included in the third conveying path 13, from the upper side of the distinguishing unit 6, which makes it possible to increase the visibility of the jammed banknote 3.

In the following, in order to compare with the opening-and-closing mechanism 21 according to the embodiment, a configuration of an opening-and-closing mechanism in a banknote handling apparatus used in a related technology, will be described. In the banknote handling apparatus according to the related technology, a distinguishing unit is arranged at the location in which, in an 8-letter shaped conveying path, two conveying paths each having a ring shape located on the upper side and the lower side are connected. Consequently, because an upper part route extends over an upper part of the distinguishing unit, when both side routes of the distinguishing unit in a conveying path are opened, there is a need to sequentially open the both side routes after opening the upper part route of the distinguishing unit. Because of this, the opening-and-closing mechanism according to the related technology includes an upper portion, which is used to open the upper part route of the distinguishing unit, and both side portions each of which opens the corresponding both side routes of the distinguishing unit and, furthermore, includes a frame that supports, for example, the upper portion so as to be rotatable about a supporting point of rotation, thus resulting in complication of the opening-and-closing mechanism. Furthermore, because the opening-and-closing mechanism is complicated, even in a state in which the upper portion and the both side portions are opened, the visibility of the both side routes and the upper part route of the distinguishing unit is low, thereby it is difficult to find a jammed banknote in the vicinity of the distinguishing unit, which is inconvenient. For example, when performing maintenance on the both side routes of the distinguishing unit, the space, in which a maintenance person inserts his or her hand toward the both side routes of the distinguishing unit from the opened upper portion of the upper part route of the distinguishing unit, tends to be narrow, thereby a maintenance task at the time of jamming was complicated.

In contrast, with the banknote handling apparatus 1 according to the embodiment, as described above, because the non-conveying area 15 described above is provided above the distinguishing unit 6, it is possible to avoid the configuration of the opening-and-closing mechanism 21 being restricted by the conveying path, which is located above the distinguishing unit 6, as described in the related technology. Consequently, because the embodiment can increase the flexibility of the structure of the opening-and-closing mechanism 21, the opening-and-closing mechanism 21 can be simplified. By simplifying the opening-and-closing mechanism 21, for example, when the linear path 12*a*, which is located on the upper side of the second conveying path 12, is opened, it is possible to ensure a large space, which is used for a maintenance person to insert his or her hand into the linear path 12*a*, and a maintenance task at the time of jamming is not prevented by a part of the opening-and-closing mechanism 21, thus improving the workability.

Furthermore, because the opening-and-closing mechanism 21 can open both the linear path 12*a*, which is located on the upper side of the second conveying path 12, and the linear path 13*a*, which is included in the third conveying path 13, by a single operation in conjunction with each other via the link member 23, it is possible to easily perform the maintenance task of the two-way direction conveying path 9.

Figure 4:
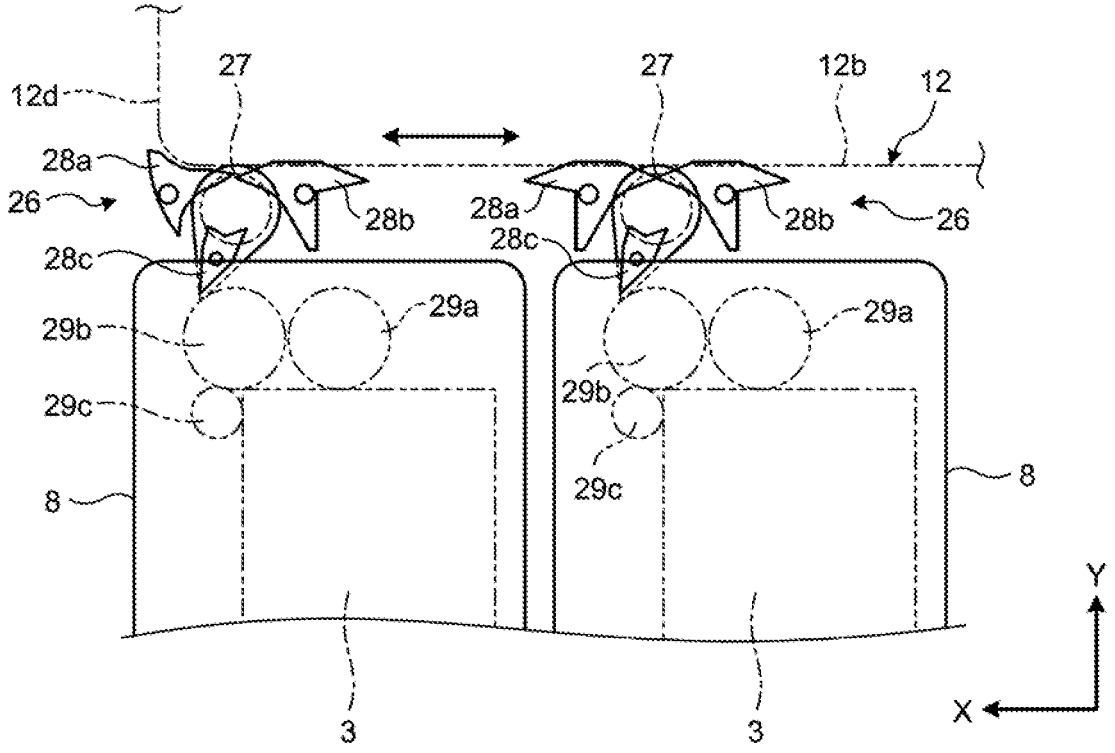
FIG. 4 is a schematic diagram illustrating a storage unit included in the banknote handling apparatus according to the embodiment.

FIG. 4 is a schematic diagram illustrating the storage unit 8 included in the banknote handling apparatus 1 according to the embodiment. The storage unit 8 includes, as illustrated in FIG. 4, a switching mechanism 26 that switches the conveying direction of the banknote 3 between the second conveying path 12, which is included in the two-way direction conveying path 9, and the storage unit 8.

The switching mechanism 26 includes a guide roller 27 that guides the conveying direction of the banknote 3, and includes three switching members 28*a* to 28*c* for switching the conveying direction of the banknote 3, and is connected to the control unit 14. Furthermore, a pick roller 29*a*, a feeding roller 29*b*, a separation roller 29*c*, and the like are provided in the storage unit 8, and the banknotes 3, which is stored in the storage unit 8, are fed one by one.

The guide roller 27 is arranged between the linear path 12*b*, which is located on the lower side of the second conveying path 12, and the storage unit 8. Each of the three switching members 28*a* to 28*c* is formed in a wedge shape having a guide surface that guides the banknote 3, and is arranged adjacent to the outer circumference surface of the guide roller 27. The orientation of each of the switching members 28*a* to 28*c* with respect to the outer circumference surface of the guide roller 27, is switched by the control unit 14 in accordance with the conveying direction of the banknote 3, thereby the route of the banknote 3 with respect to the guide roller 27 is changed between the storage unit 8 and the linear path 12*b*, and thus the conveying direction of the banknote 3 is switched.

As described above, because the storage unit 8 includes the switching mechanism 26, it is possible to convey the banknote 3 by switching the conveying direction between the linear path 12*b*, which is located on the lower side of the second conveying path 12, and storage unit 8, in accordance with switching the conveying direction of the second conveying path 12.

Furthermore, at a predetermined position of each of the first conveying path 11, the second conveying path 12, and the third conveying path 13 that are included in the two-way direction conveying path 9, for example, as illustrated in FIG. 1, a plurality of position sensors 17, which detect passing of the banknote 3, is provided. Each of the position sensors 17 is connected to the control unit 14. For example, optical sensors are used as the position sensors 17. Each of the position sensors 17 includes a light-emitting unit, which emits detection light toward the two-way direction conveying path 9, and a light-receiving unit, which receives the detection light emitted by the light-emitting unit.

Figure 5:
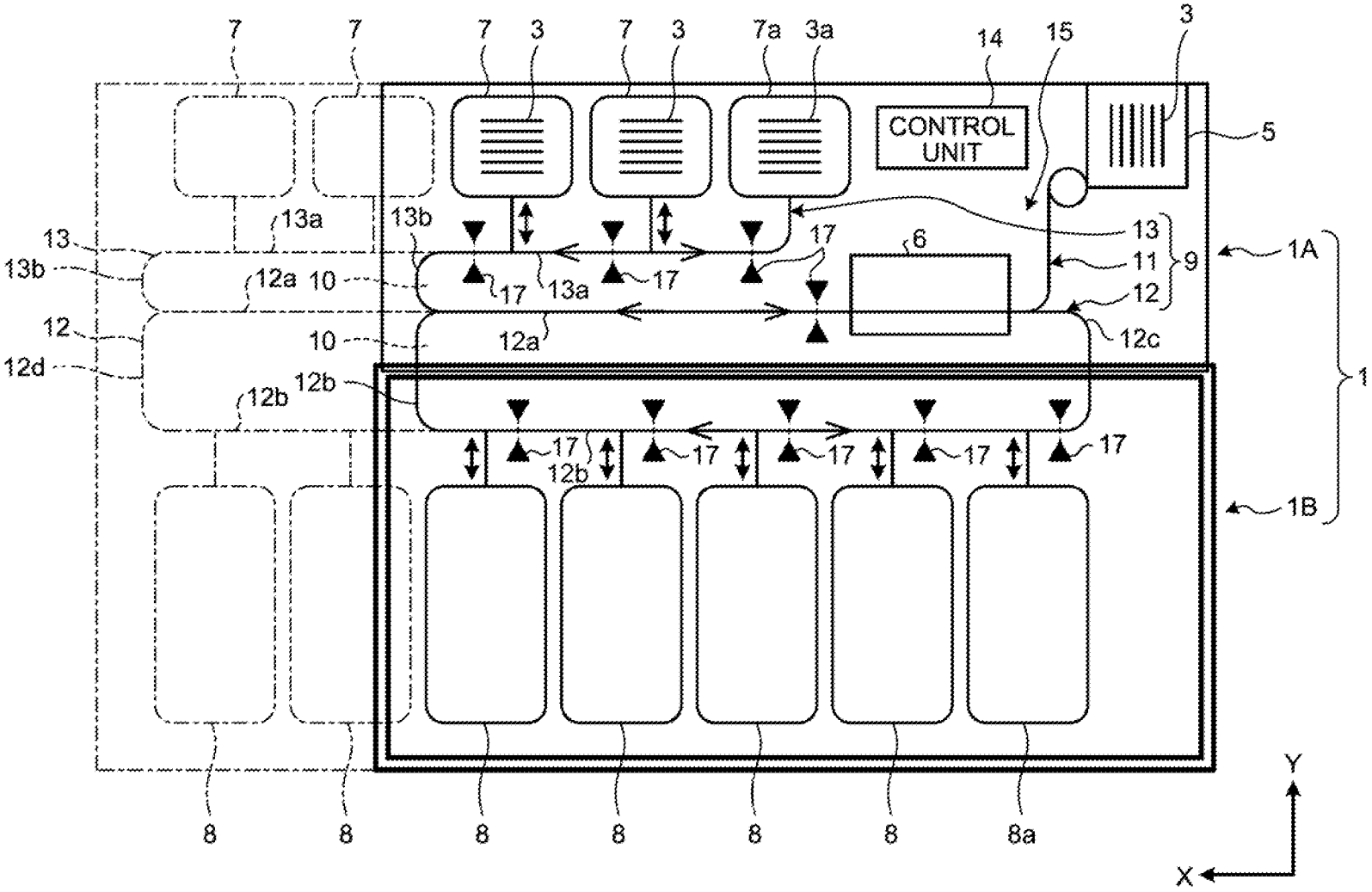
FIG. 5 is a schematic diagram illustrating holding units and storage units are added to the banknote handling apparatus according to the embodiment.

The control unit 14 determines that a jam of the banknote 3 has occurred in the two-way direction conveying path, 9 based on the detection results obtained by the position sensors 17, when a predetermined time has elapsed in a state, in which passing of the banknote 3 was not detected in the two-way direction conveying path 9, or when a predetermined time has elapsed in a state, in which the banknote 3 was detected. Furthermore, the configuration, in which the control unit 14 detects the occurrence of jam of the banknote 3, is not limited to the configuration, in which the position sensors 17 are used. The control unit 14 may also determine a jam based on a change in rotational resistance of, for example, the conveying belt or the conveying roller in the conveying mechanism 10. [0039] (Addition of holding unit and storage unit) FIG. 5 is a schematic diagram illustrating the holding units 7 and the storage units 8 are added to the banknote handling apparatus 1 according to the embodiment. After having installed the banknote handling apparatus 1 according to the embodiment, in order to meet the needs of environment the banknote handling apparatus 1 to be handled, as illustrated in FIG. 5, by extending a single set of the linear paths 12*a* and 12*b* in the second conveying path 12 and extending the linear path 13*a* of the third conveying path 13 in the X direction, it is possible to easily increase the number of the holding units 7, which is connected to the linear path 13*a* that is included in the third conveying path 13, and the number of the storage units 8, which is connected to the linear path 12*b* that is located on the lower side of the second conveying path 12.

Figure 6:
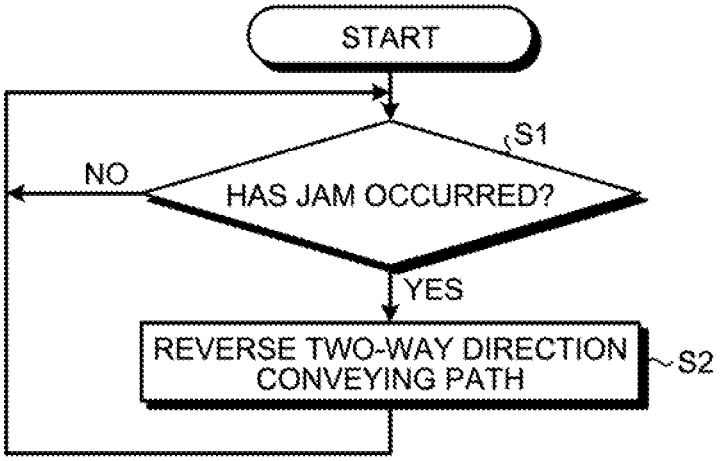
FIG. 6 is a flowchart for explaining a conveying operation performed when a jam occurs in the banknote handling apparatus according to the embodiment.

(Conveying operation of banknote at the time of occurrence of jam) FIG. 6 is a flowchart for explaining a conveying operation performed when a jam has occurred in the banknote handling apparatus 1 according to the embodiment. As illustrated in FIG. 6, when a banknote is handled by the banknote handling apparatus 1, the control unit 14 determines, based on the detection results obtained by the position sensors 17, whether a jam of the banknote 3 has occurred in the two-way direction conveying path 9 (Step S1). If the banknote 3 is not able to be conveyed in the two-way direction conveying path 9, the control unit 14 determines, based on the detection results obtained by the position sensors 17, that a jam of the banknote 3 has occurred in the two-way direction conveying path 9. If it is determined that a jam has occurred, the control unit 14 performs control such that the conveying direction of the banknote 3 in the two-way direction conveying path 9 is switched to the direction opposite to the direction, in which the banknote 3 was conveyed just before the occurrence of the jam of the banknote 3, and is reversed (Step S2). At Step S11, if it is determined that a jam does not occur, the control unit 14 continuously determines, based on the detection results obtained by the position sensor 17, whether a jam has occurred.

For example, if a jam has occurred, at the time of deposit, when the banknote 3 is accommodated from the deposit and withdrawal unit 5 to the holding unit 7, by controlling the conveying mechanism 10, the control unit 14 reverses the conveying direction of, for example, the second conveying path 12 of the two-way direction conveying path 9, and returns the jammed banknote 3 to the deposit and withdrawal unit 5. Furthermore, for example, if a jam has occurred, at the time of deposit, when the banknote 3 is sent from the storage unit 8 to the deposit and withdrawal unit 5, by controlling the conveying mechanism 10, the control unit 14 reverses the conveying direction of, for example, the second conveying path 12 of the two-way direction conveying path 9 and accommodates the jammed banknote 3 to the collecting unit 8*a*. Furthermore, even if a jam has occurred in any one of the routes in the two-way direction conveying path 9 at the time of process that is different from the process performed at the time of deposit or withdrawal, the control unit 14 reverses the conveying direction of the two-way direction conveying path 9, thereby it is possible to automatically resolve the jam.

As described above, by switching, at the time of deposit or withdrawal, the conveying direction of the two-way direction conveying path 9 to the opposite direction, the banknote handling apparatus 1 can move and convey the jammed banknote 3, thereby it is possible to automatically resolve the jam. Furthermore, the control unit 14 determines, based on the detection results obtained by the position sensors 17, whether the jammed banknote 3 can be conveyed and may also perform control such that an attempt to move the jammed banknote 3 until, for example, conveyance of the jammed banknote 3 is detected. At this time, the control unit 14 may also perform control such that the operation of the two-way direction conveying path 9 in both forward and reverse directions, is performed by the predetermined number of times, or such that a conveying speed when the conveying direction of the two-way direction conveying path 9 is reversed, is gradually changed.

Furthermore, if a jam of the banknote 3 is not automatically resolved by the control operation that is performed by the control unit 14 described above, the second conveying path 12, the third conveying path 13, or the like of the two-way direction conveying path 9 is manually opened by using the opening-and-closing mechanism 21, and then the jammed banknote 3 is removed from the two-way direction conveying path 9. In the embodiment, as described above, by using the opening-and-closing mechanism 21, both of the linear path 12*a* in the second conveying path 12 and linear path 13*a* in the third conveying path 13 are configured so as to be capable of being opened and closed in conjunction with each other, thereby it is possible to easily perform a maintenance task.

Furthermore, because each of the linear path 12*a*, which is located on the upper side of the second conveying path 12, and the linear path 13*a* in the third conveying path 13, can be widely opened by using the opening-and-closing mechanism 21, it is possible to easily find a location, in which a jam has occurred, in the linear paths 12*a* and 13*a* each forming a straight road, thereby it is possible to appropriately remove the jammed banknote 3. Consequently, it is possible to reduce the number of times a so-called patrol ticket (check sheet) is used to check the two-way direction conveying path 9 after the jam has been resolved, thereby it is possible to improve the workability of the maintenance task.

(Handling Process of Damaged Banknotes)

In the banknote handling apparatus 1, based on the judgement result obtained by the distinguishing unit 6, from among the banknotes sent from the deposit and withdrawal unit 5 at the time of deposit, the normal banknote 3 is accommodated in the holding unit 7 and the damaged banknote 3*a* is accommodated in the damaged banknote holding unit 7*a*. Namely, in the banknote handling apparatus 1, all of the damaged banknotes 3*a*, which are received at the time of deposit, are briefly accommodated to the damaged banknote holding unit 7*a*.

After the control unit 14 briefly accommodates the damaged banknotes 3*a* sent from the deposit and withdrawal unit 5 in the damaged banknote holding unit 7*a*, the control unit 14 collectively sends the damaged banknotes 3*a* from the damaged banknote holding unit 7*a* to the deposit and withdrawal unit 5. At this time, the control unit 14 performs control such that a conveying speed at the time, at which the damaged banknotes 3*a* are sent from the damaged banknote holding unit 7*a* to the deposit and withdrawal unit 5, is lower than a conveying speed at the time, at which the banknotes 3 including the damaged banknotes 3*a* are sent from the deposit and withdrawal unit 5 to the holding unit 7 and the damaged banknote holding unit 7*a*, respectively.

The conveying speed of the banknote 3 in the banknote handling apparatus 1 is set in accordance with, for example, the number of times the damaged banknote 3*a* is handled at the time of deposit, or the deterioration state of the damaged banknote 3*a*, and is set to, for example, about 1000 [mm/s]. The control unit 14 performs control such that, when the damaged banknotes 3*a* are collectively sent from the damaged banknote holding unit 7*a* to the deposit and withdrawal unit 5, the conveying speed of the damaged banknote 3*a* to be returned, is set to be a low conveying speed of about, for example, 400 [mm/s] to 500 [mm/s]. Consequently, it is possible to prevent the occurrence of jam when the damaged banknote 3*a*, which tends to be jammed, is returned to the deposit and withdrawal unit 5.

Furthermore, in addition to decreasing the conveying speed of the damaged banknote 3*a*, the control unit 14 may also perform control such that a conveyance interval of conveying the damaged banknotes 3*a* from the damaged banknote holding unit 7*a* to the deposit and withdrawal unit 5, is increased, compared with a conveyance interval of conveying the banknote 3 sent from the deposit and withdrawal unit 5 to the holding unit 7. Consequently, it is possible to further reduce the occurrence of jam when the damaged banknotes 3*a* are returned to the deposit and withdrawal unit 5.

(Banknote handling method according to embodiment)

Figure 7:
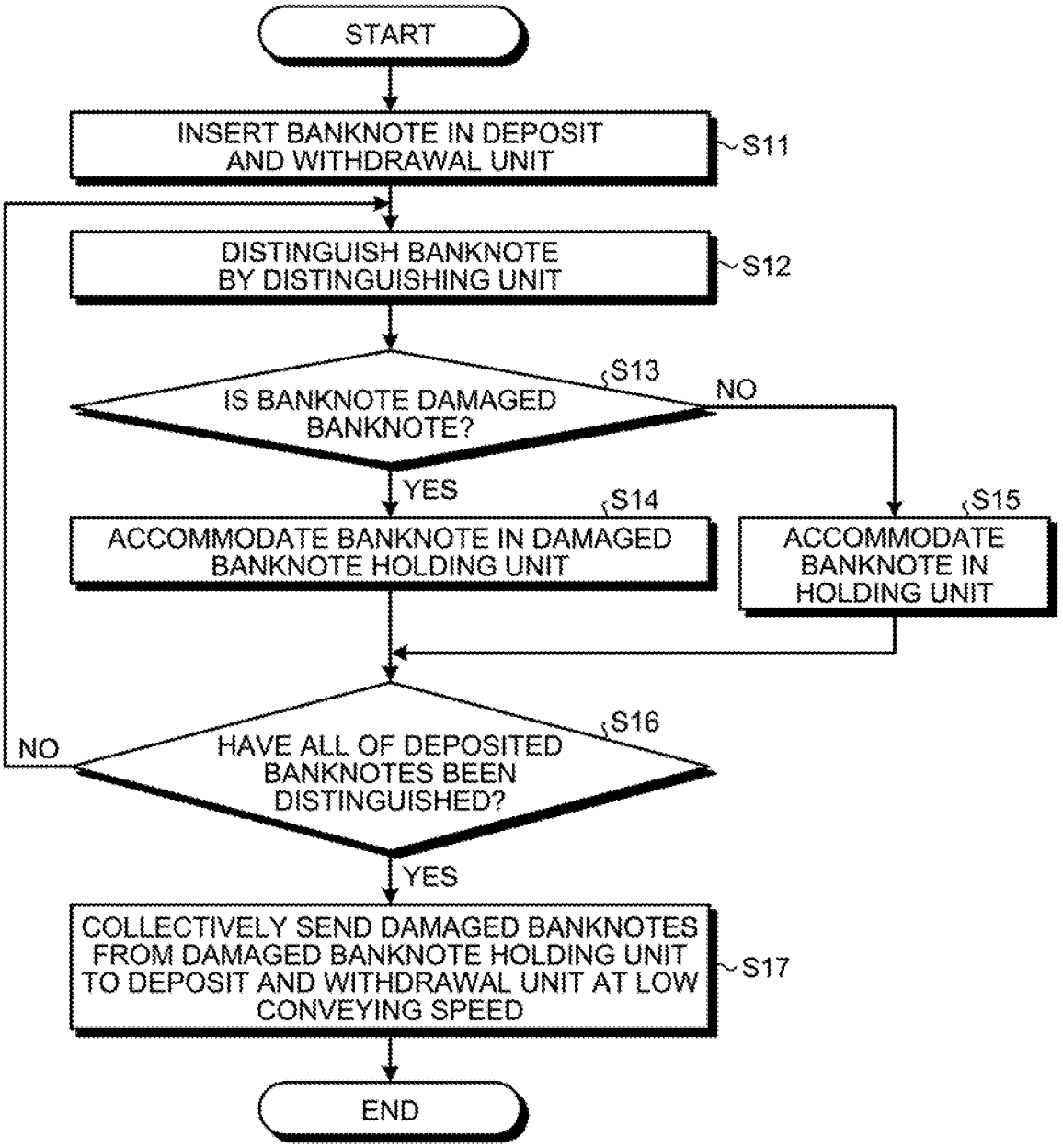
FIG. 7 is a flowchart for explaining a banknote handling method according to the embodiment.

FIG. 7 is a flowchart for explaining a banknote handling method according to the embodiment. In the banknote handling method according to the embodiment performed by using the banknote handling apparatus 1 configured as described above, as illustrated in FIG. 7, after the banknote 3 has been inserted in the deposit and withdrawal unit 5 at the time of deposit (Step S11), the banknote 3 is sent from the deposit and withdrawal unit 5 to the distinguishing unit 6 by the two-way direction conveying path 9, and is distinguished by the distinguishing unit 6 (Step S12). Subsequently, the control unit 14 determines, based on the judgement result obtained by the distinguishing unit 6, whether the banknote 3 passing through the distinguishing unit 6, is the damaged banknote 3*a* (Step S13).

If it is determined, by the control unit 14 based on the judgement result obtained by the distinguishing unit 6, that the banknote 3 sent from the deposit and withdrawal unit 5, is the damaged banknote 3*a*, the banknote handling apparatus 1 temporarily accommodates the damaged banknote 3*a* in the damaged banknote holding unit 7*a* (Step S14). In contrast, if it is determined, by the control unit 14 based on the judgement result obtained by the distinguishing unit 6, that the banknote 3 sent from the deposit and withdrawal unit 5, is not the damaged banknote 3*a* (normal banknote), the banknote handling apparatus 1 temporarily accommodates the banknote 3, which is sent from the deposit and withdrawal unit 5 through the two-way direction conveying path 9, in the holding unit 7 (Step S15). Subsequently, the control unit 14 determines whether all of the banknotes 3 inserted in the deposit and withdrawal unit 5 have been distinguished by the distinguishing unit 6 (Step S16).

In the banknote handling apparatus 1, if it is determined that all of the deposited banknotes 3 have been distinguished by the distinguishing unit 6, i.e., after all of the damaged banknotes 3*a*, which are sent from the deposit and withdrawal unit 5, have briefly been accommodated in the damaged banknote holding unit 7*a*, the control unit 14 performs control such that all of the damaged banknotes 3*a* are collectively sent from the damaged banknote holding unit 7*a* to the deposit and withdrawal unit 5 by using the two-way direction conveying path 9, and the control unit 14 also performs control such that the conveying speed at the time, at which the damaged banknotes 3*a* are sent, is lower than the conveying speed at the time, at which the banknotes 3 are sent from the deposit and withdrawal unit 5 (Step S17).

As described above, the banknote handling apparatus 1 according to the embodiment described above includes the conveying mechanism 10, which includes the two-way direction conveying path 9 that connects the deposit and withdrawal unit 5, the distinguishing unit 6, the holding unit 7, and the storage unit 8 with each other and that conveys the banknote 3 in both directions, and the control unit 14 that controls the conveying mechanism 10. Consequently, the banknote handling apparatus 1 can convey the banknote 3 to the opposite direction in any of the routes in the two-way direction conveying path 9. Consequently, if a jam of the banknote 3 has occurred in the two-way direction conveying path 9, the banknote handling apparatus 1 allows the control unit 14 to control the conveying mechanism 10 and allows the conveying direction of the two-way direction conveying path 9 to be reversed, whereby it is possible to convey the jammed banknote 3 along the two-way direction conveying path 9 and thus it is possible automatically resolve the jam. As a result, the banknote handling apparatus 1 can reduce the number of times the maintenance task for resolving a jam is to be performed, and reduce stoppages of the banknote handling apparatus 1 due to the maintenance task.

Furthermore, in the banknote handling apparatus 1 according to the embodiment, the distinguishing unit 6 is arranged in the linear path 12*a* that is located on the upper side of the second conveying path 12; the storage unit 8 is connected to the linear path 12*b* that is located on the lower side of the second conveying path 12; and the non-conveying area 15, in which the banknote 3 is not conveyed along the linear path 12*a*, is provided on the outer circumference side of the ring shaped second conveying path 12 with respect to the distinguishing unit 6. Because the non-conveying area 15 is provided above the distinguishing unit 6, it is possible to increase the flexibility of the configuration of the opening-and-closing mechanism 21 that is used to open the second conveying path 12, in which the distinguishing unit 6 is arranged, and it is possible to simplify the opening-and-closing mechanism 21. Furthermore, by simplifying the opening-and-closing mechanism 21, it is possible to ensure a large space of the linear path 12*a* of the second conveying path 12, thereby it is possible to improve the visibility of the jammed banknote 3 and the workability of the maintenance task at the time of jam. Consequently, it is possible to reduce the down time of the banknote handling apparatus 1 due to the maintenance task.

Furthermore, because the two-way direction conveying path 9 in the banknote handling apparatus 1 is configured such that the first conveying path 11 having a linear shape and the third conveying path 13 having a linear shape, are connected to the second conveying path 12 having a ring shape, it is possible to reduce the number of branch portions of the routes in the two-way direction conveying path 9, thereby it is possible to simplify the entirety of the two-way direction conveying path 9. Consequently, it is possible to easily track and find the jammed banknote 3, this makes it possible to improve the workability of the maintenance task.

Furthermore, in the banknote handling apparatus 1 according to the embodiment, because the non-conveying area 15 is provided, it is possible to decrease the height (the height of the upper row portion 1A) occupied by the upper portion of the distinguishing unit 6 in the banknote handling apparatus 1, and increase the height (the height of the lower row portion 1B) occupied by the lower part of the distinguishing unit 6, which makes it possible to ensure the size of each of the storage units 8.

Furthermore, in the banknote handling apparatus 1 according to the embodiment, because the linear third conveying path 13 is provided, the route, which connects the deposit and withdrawal unit 5 and the holding units 7 and the damaged banknote holding unit 7*a*, is configured by a single path, and the third conveying path 13 has termination (dead end). Consequently, it is possible to easily track the jammed banknote 3 along the single path of the route when the jam has occurred, and thus it is possible to easily find the location in which the jam has occurred in the two-way direction conveying path 9. Accordingly, it is possible to improve the workability of the maintenance task of resolving the jam, and reduce the down time of the banknote handling apparatus 1 due to the maintenance task.

Furthermore, the two-way direction conveying path 9 in the banknote handling apparatus 1 according to the embodiment includes the second conveying path 12, which has a set of the linear paths 12*a* and 12*b* that are parallel with each other, and the third conveying path 13, which has the linear path 13*a* extending parallel to the linear paths 12*a* and 12*b* that are included in the second conveying path 12. Consequently, in accordance with an actual use environment in the banknote handling apparatus 1, by extending the set of the linear paths 12*a* and 12*b* that are arranged on the upper side and the lower side of the second conveying path 12, respectively, and by extending the linear path 13*a*, which is included in the third conveying path 13, along the one-way direction (X direction), it is possible to easily add the holding units 7, the damaged banknote holding unit 7*a*, the storage units 8, and the collecting unit 8*a*. Furthermore, because it is possible to extend the second conveying path 12 along, for example, the one-way direction that is the depth direction of the banknote handling apparatus 1, and add the holding unit 7 to the second conveying path 12, thereby it is possible to increase the number of the holding units 7 without changing the height (Y direction) of the banknote handling apparatus 1.

By increasing the number of the holding units 7 in this way, it is possible to further finely classify the banknotes 3, accommodate the classified banknotes 3, and separately perform the handling process in accordance with the classified banknotes 3, thereby it is possible to increase the extensibility of adding control of various handling processes as needed. Furthermore, because it is possible to easily increase the number of the holding units 7, by providing a counterfeit banknote holding unit that is used to accommodate only the counterfeit banknotes out of the banknotes 3, thereby this makes it possible to perform a handling process of, for example, reporting to the security by the control unit 14.

Furthermore, the conveying mechanism 10, which is included in the banknote handling apparatus 1, according to the embodiment, includes the opening-and-closing mechanism 21 that opens and closed by operating the linear path 13*a*, which is included in the third conveying path 13, in conjunction with a part of the linear path 12*a*, which is included in the second conveying path 12 and which is parallel to the linear path 13*a*. Because the opening-and-closing mechanism 21 works in conjunction with the linear path 12*a* and the linear path 13*a* via the link member 23 in this way, the opening-and-closing mechanism 21 can open the linear path 12*a* in the second conveying path 12 and the linear path 13*a* in the third conveying path 13 by a single operation. Consequently, when the jammed banknote 3 is removed from above the two-way direction conveying path 9, it is possible to easily open the second conveying path 12 and the third conveying path 13, which makes it possible to easily perform a maintenance task of the two-way direction conveying path 9.

Furthermore, the control unit 14 in the banknote handling apparatus 1 according to the embodiment, accommodates the damaged banknotes 3*a*, which is sent from the deposit and withdrawal unit 5, in the damaged banknote holding unit 7*a*, and then collectively sends the damaged banknotes 3*a* from the damaged banknote holding unit 7*a* to the deposit and withdrawal unit 5. The control unit 14 performs control such that the conveying speed at the time, at which the damaged banknotes 3*a* are sent, is to be lower than the conveying speed at the time, at which the banknotes 3 including the damaged banknotes 3*a* are sent from the deposit and withdrawal unit 5 to the holding unit 7 and the damaged banknote holding unit 7*a*. In the banknote handling apparatus used in the related technology, because each of the damaged banknotes, which is generated at the time of deposit, is separately returned to the deposit and withdrawal unit, it is difficult to switch the conveying speed at the time, at which the damaged banknotes are returned to the deposit and withdrawal unit, thus possibly resulting in the occurrence of jam of the damaged banknote that is to be returned to the deposit and withdrawal unit.

In contrast, the control unit 14 in the banknote handling apparatus 1 according to the embodiment, collectively sends the damaged banknotes 3*a*, which are accommodated in the damaged banknote holding unit 7*a*, to the deposit and withdrawal unit 5, and relatively decreases the conveying speed of the damaged banknote 3*a* by considering the deterioration state of the damaged banknotes 3*a*, thereby it is possible to prevent the occurrence of jam when the damaged banknotes 3*a* are returned. Furthermore, by briefly accommodating the damaged banknote 3*a* in the damaged banknote holding unit 7*a* at the time of deposit, it is possible to reduce the processing time of the banknotes 3 at the time of deposit, when compared with a case in which, as described in the related technology, each of the damaged banknotes is separately returned to the deposit and withdrawal unit at the time of deposit. For example, when a large number of the banknotes 3 is refilled from the deposit and withdrawal unit 5 to the banknote handling apparatus 1, even if a large number of the damaged banknotes 3*a* has occurred, it is possible to collectively return only the damaged banknotes 3*a* to the deposit and withdrawal unit 5 by increasing the number of the holding units 7 and the damaged banknote holding units 7*a*. Furthermore, as needed, the control unit 14 increases the conveyance interval of the damaged banknotes 3*a* when the damaged banknotes 3*a* are sent from the damaged banknote holding unit 7*a* to the deposit and withdrawal unit 5 greater than the conveyance interval of the banknotes 3 at the time of deposit, it is possible to further reduce the occurrence of jam generated when the damaged banknotes 3*a* are returned to the deposit and withdrawal unit 5.

According to an aspect of an embodiment of the paper sheet handling apparatus disclosed in the present invention, it is possible to convey paper sheets in the opposite direction in both routes of the two-way direction conveying path.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A paper sheet handling apparatus comprising:

an input/output unit that is used to put in or take out a paper sheet;

a distinguishing unit that distinguishes the paper sheet;

an accommodating unit that temporarily accommodates the paper sheet sent from the input/output unit;

a storage unit that stores therein the paper sheet sent from the accommodating unit;

a conveying mechanism that includes a two-way direction conveying path, which connects the input/output unit, the distinguishing unit, the accommodating unit, and the storage unit with each other and which conveys the paper sheet in both directions; and a controller that is configured to control the conveying mechanism, wherein the two-way direction conveying path includes:

a first conveying path that has a linear shape and that conveys the paper sheet to the input/output unit, a second conveying path that has a ring shape and to which one end of the first conveying path is connected, and a third conveying path that has a linear shape and one end of which is connected to the second conveying path, the distinguishing unit is arranged in one route of the second conveying path, the accommodating unit is connected to the third conveying path, the storage unit is connected to another route that is parallel to the one route of the second conveying path, wherein the second conveying path includes:

a set of linear paths that are parallel with each other, and a set of connecting paths each of which connects both ends of the linear paths, and the third conveying path includes:

a linear path that extends parallel to the set of the linear paths included in the second conveying path, and a connecting path that is connected to the second conveying path, and a non-conveying area, in which the paper sheet is not conveyed along the one route, is provided on an outer circumference side of the ring shaped second conveying path with respect to the distinguishing unit.

2. The paper sheet handling apparatus according to claim 1, wherein the conveying mechanism includes an opening-and-closing mechanism that opens and closes, in conjunction with each other, the linear path included in the third conveying path, and a part of the linear paths that is included in the second conveying path and that is parallel to the linear path included in the third conveying path.

3. The paper sheet handling apparatus according to claim 1, further comprising a degraded paper sheet accommodating unit that temporarily accommodates, when the controller determines that the paper sheet sent from the input/output unit is a degraded paper sheet based on a judgement result obtained by the distinguishing unit, the degraded paper sheet, wherein the degraded paper sheet accommodating unit is connected to the third conveying path, and after the controller accommodates the degraded paper sheet sent from the input/output unit in the degraded paper sheet accommodating unit, the controller performs control such that the degraded paper sheets are collectively sent from the degraded paper sheet accommodating unit to the input/output unit and a conveying speed at the time, at which the degraded paper sheets are sent, is lower than a conveying speed at the time, at which the paper sheet is sent from the input/output unit.

4. The paper sheet handling apparatus according to claim 1, wherein, when the paper sheet is not able to be conveyed in the two-way direction conveying path, the controller performs control such that the conveying direction of the paper sheet in the two-way direction conveying path is switched to the opposite direction.

5. A paper sheet handling method comprising:

accommodating temporarily, in an accommodating unit via a distinguishing unit, a paper sheet sent by a two-way direction conveying path from an input/output unit that is used to put in or take out the paper sheet;

accommodating temporarily, when it is determined by a controller that the paper sheet sent from the input/output unit is a degraded paper sheet based on a judgement result obtained by the distinguishing unit, the degraded paper sheet in a degraded paper sheet accommodating unit; and performing control of, by the controller after having accommodated the degraded paper sheet, which is sent from the input/output unit, in the degraded paper sheet accommodating unit, collectively sending the degraded paper sheets from the degraded paper sheet accommodating unit to the input/output unit by the two-way direction conveying path and setting a conveying speed at the time, at which the degraded paper sheets are sent, to be lower than a conveying speed at the time, at which a paper sheet is sent from the input/output unit.

* * * * *